US010263344B2

(12) United States Patent
Harauchi

(10) Patent No.: US 10,263,344 B2
(45) Date of Patent: Apr. 16, 2019

(54) HIGH-FREQUENCY ANTENNA MODULE AND ARRAY ANTENNA DEVICE

(71) Applicant: Mitsubishi Electric Corporation, Chiyoda-ku (JP)

(72) Inventor: Kenji Harauchi, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 0 days.

(21) Appl. No.: 15/740,133

(22) PCT Filed: Oct. 27, 2016

(86) PCT No.: PCT/JP2016/081819
§ 371 (c)(1),
(2) Date: Dec. 27, 2017

(87) PCT Pub. No.: WO2017/073644
PCT Pub. Date: May 4, 2017

(65) Prior Publication Data

US 2018/0316096 A1 Nov. 1, 2018

(30) Foreign Application Priority Data

Oct. 30, 2015 (JP) ..... 2015-214106

(51) Int. Cl.
*H01Q 21/06* (2006.01)
*H01Q 21/22* (2006.01)
(Continued)

(52) U.S. Cl.
CPC ..... *H01Q 21/061* (2013.01); *H01Q 1/02* (2013.01); *H01Q 21/0025* (2013.01);
(Continued)

(58) Field of Classification Search
CPC .... H01Q 21/061; H01Q 21/065; H01Q 21/22; H01Q 23/00
See application file for complete search history.

(56) References Cited

U.S. PATENT DOCUMENTS 5,001,493 A * 3/1991 Patin ..... H01Q 21/065 343/700 MS
6,496,158 B1 * 12/2002 Ksienski ..... H01Q 3/36 342/374
(Continued)

FOREIGN PATENT DOCUMENTS

JP 01-154607 A 6/1989
JP 04-035301 A 2/1992
(Continued)

OTHER PUBLICATIONS

English Translation of Written Opinion of PCT/JP2016/081819, dated Jan. 17, 2017 (Year: 2017).*
(Continued)

*Primary Examiner* — Dameon E Levi
*Assistant Examiner* — Jennifer F Hu
(74) *Attorney, Agent, or Firm* — Oblon, McClelland, Maier & Neustadt, L.L.P.

(57) ABSTRACT

A high-frequency antenna module includes: a substrate; an input port to which an RF signal is inputted; a distribution circuit configured to distribute the RF signal inputted to the input port; a plurality of amplification units which each have a plurality of cascade-connected amplifiers configured to amplify the RF signal distributed by the distribution circuit, and which are arranged on a side of the substrate provided with the distribution circuit to be rotationally symmetric about the distribution circuit; a plurality of antennas provided on a side of the substrate opposite to the side provided with the amplification units, and each configured to emit the RF signal amplified by the amplification unit corresponding
(Continued)

thereto to a space; and a plurality of RF signal supplying portions each configured to supply the RF signal amplified by the amplification unit to the antenna corresponding thereto.

18 Claims, 16 Drawing Sheets

(51) Int. Cl.
*H01Q 23/00* (2006.01)
*H01Q 21/00* (2006.01)
*H01Q 1/02* (2006.01)

(52) U.S. Cl.
CPC ..... *H01Q 21/0093* (2013.01); *H01Q 21/22* (2013.01); *H01Q 23/00* (2013.01)

(56) References Cited

U.S. PATENT DOCUMENTS

2001/0007446 A1* 7/2001 Amano ..... H01Q 1/50 343/860
2006/0084378 A1* 4/2006 Ksienski ..... H01Q 21/061 455/25
2010/0045555 A1* 2/2010 Ryou ..... H01Q 3/01 343/757
2012/0319746 A1 12/2012 Hayashi et al.
2017/0104275 A1* 4/2017 Yanagisawa ..... H01Q 9/38

FOREIGN PATENT DOCUMENTS

JP 04-160804 A 6/1992
JP 2012-109670 A 6/2012
JP 2014-017598 A 1/2014

OTHER PUBLICATIONS

Decision to Grant a Patent dated Jul. 6, 2017 in Japanese application No. 2017-510694 (with English translation).
Office Action dated May 25, 2017 in Japanese application No. 2017-510694 (with English translation).
International Search Report dated Jan. 17, 2017 in PCT/JP2016/081819, filed on Oct. 27, 2016 (English translation provided herewith).
European Search Report dated Aug. 20, 2018 in Patent Application No. 16859873.8, citing documents AA and AX therein, 10 pages.
Sanzgiri, S. et al. "A Hybrid Tile Approach for Ka Band Subarray Modules" IEEE transactions on Antennas and Propagation, vol. 43, No. 9, XP000522587, 1995, pp. 953-959.
U.S. Appl. No. 15/504,240, filed Feb. 15, 2017, US 2017/0250120 A1, Kenji Harauchi et al.
U.S. Appl. No. 15/525,169, filed May 8, 2017, US 2017/0331439 A1, Hiroyuki Nonomura.

* cited by examiner

HIGH-FREQUENCY ANTENNA MODULE AND ARRAY ANTENNA DEVICE

TECHNICAL FIELD

The present disclosure relates to a high-frequency antenna module which emits a high-frequency signal to a space, and an array antenna device using the same.

BACKGROUND ART

A high-frequency module for amplifying a microwave signal is used for a communication device, a radar device, a power transmission device, and the like. For example, in an active phased array antenna, a plurality of high-frequency modules are connected in parallel for power synthesis and beam control. There have been proposed several methods for achieving a thinner and smaller-sized array antenna device by sharing an input connector, distributing a signal to a plurality of high-frequency modules, and thereby reducing the number of coaxial connectors.

There has been proposed a method in which an insulating substrate equipped with high-frequency electronic components and an antenna substrate equipped with a plurality of antennas are arranged with a metal casing being sandwiched therebetween, these substrates are connected by one coaxial cable, and the antenna substrate performs distribution (see Patent Document 1).

There has been proposed a method in which a plurality of antennas, amplification circuits for the respective antennas, and a distribution circuit configured to distribute an RF (Radio Frequency) signal to the respective amplification circuits are integrated and implemented in a single-layer substrate or a multilayer substrate (see Patent Document 2).

CITATION LIST

Patent Document

Patent Document 1: Japanese Patent Laying-Open No. 2012-109670

Patent Document 2: Japanese Patent Laying-Open No. 2014-017598

SUMMARY OF DISCLOSURE

Technical Problem

With the method of Patent Document 1, it is difficult to achieve a further thinner high-frequency module, because the high-frequency electronic components are separated from the antenna substrate. In a high-frequency module having a plurality of antennas, lengths of wires from a distribution circuit to the antennas should be identical. However, Patent Document 2 has no description about the lengths of wires.

The present disclosure has been made to solve the aforementioned problems, and an object of the present disclosure is to obtain a high-frequency antenna module which can easily match phases of a plurality of antennas when an input connector is shared and a distribution circuit is used to distribute a signal to the plurality of antennas, and which achieves reduction in thickness.

Solution to Problem

A high-frequency antenna module according to the present disclosure includes: a substrate; an input port to which an RF signal is inputted; a distribution circuit configured to distribute the RF signal inputted to the input port; a plurality of amplification units which each have a plurality of cascade-connected amplifiers configured to amplify the RF signal distributed by the distribution circuit, and which are arranged on a side of the substrate provided with the distribution circuit to be rotationally symmetric about the distribution circuit; a plurality of antennas provided on a side of the substrate opposite to the side provided with the amplification units, and each configured to emit the RF signal amplified by the amplification unit corresponding thereto to a space; and a plurality of RF signal supplying portions each configured to supply the RF signal amplified by the amplification unit to the antenna corresponding thereto.

Advantageous Effects of Disclosure

According to the present disclosure, a high-frequency antenna module which achieves an equal length of wires to a plurality of antennas when an input connector is shared and a distribution circuit is used to distribute a signal to the plurality of antennas, and which can achieve reduction in thickness is obtained.

DESCRIPTION OF EMBODIMENTS

First Embodiment

Figure 1:
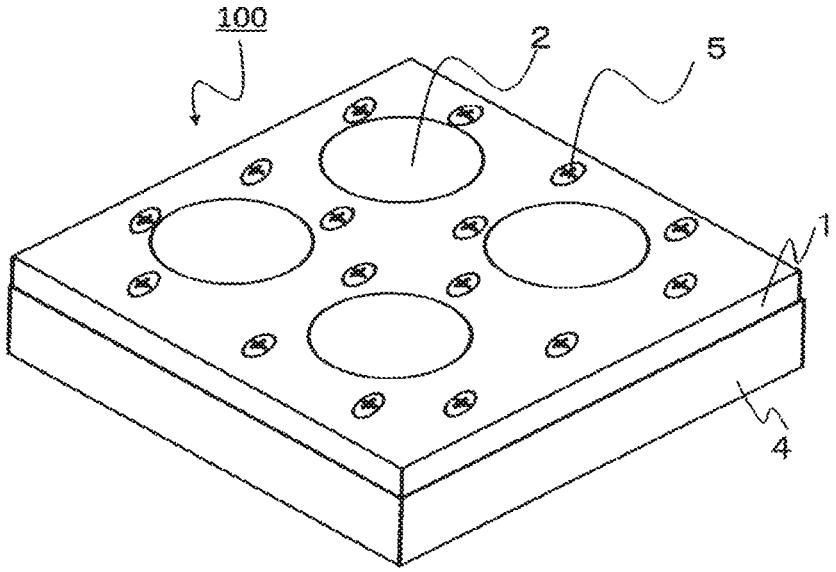
FIG. 1 is a perspective view of a high-frequency antenna module according to a first embodiment of the present disclosure, seen from an antenna side.
Figure 2:
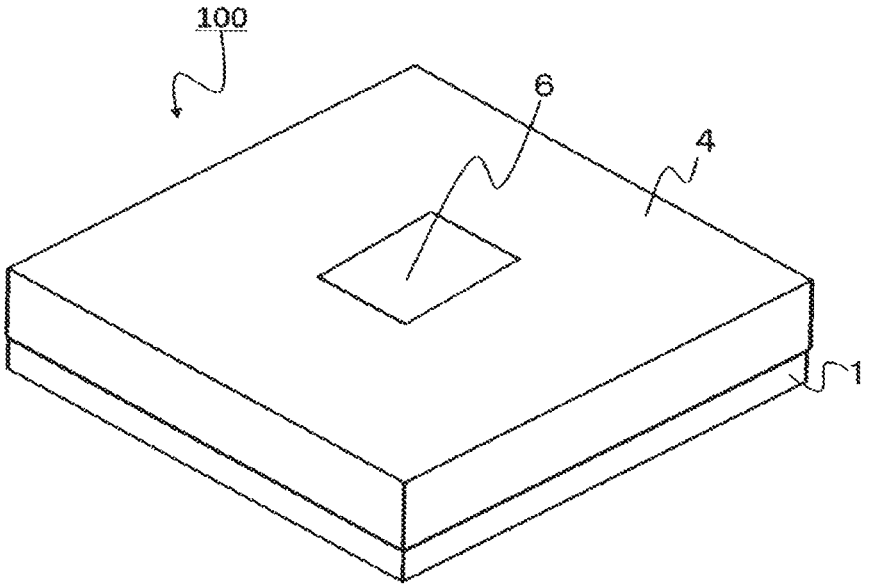
FIG. 2 is a perspective view of the high-frequency antenna module seen from a metal block side, in the high-frequency antenna module according to the first embodiment.
Figure 3:
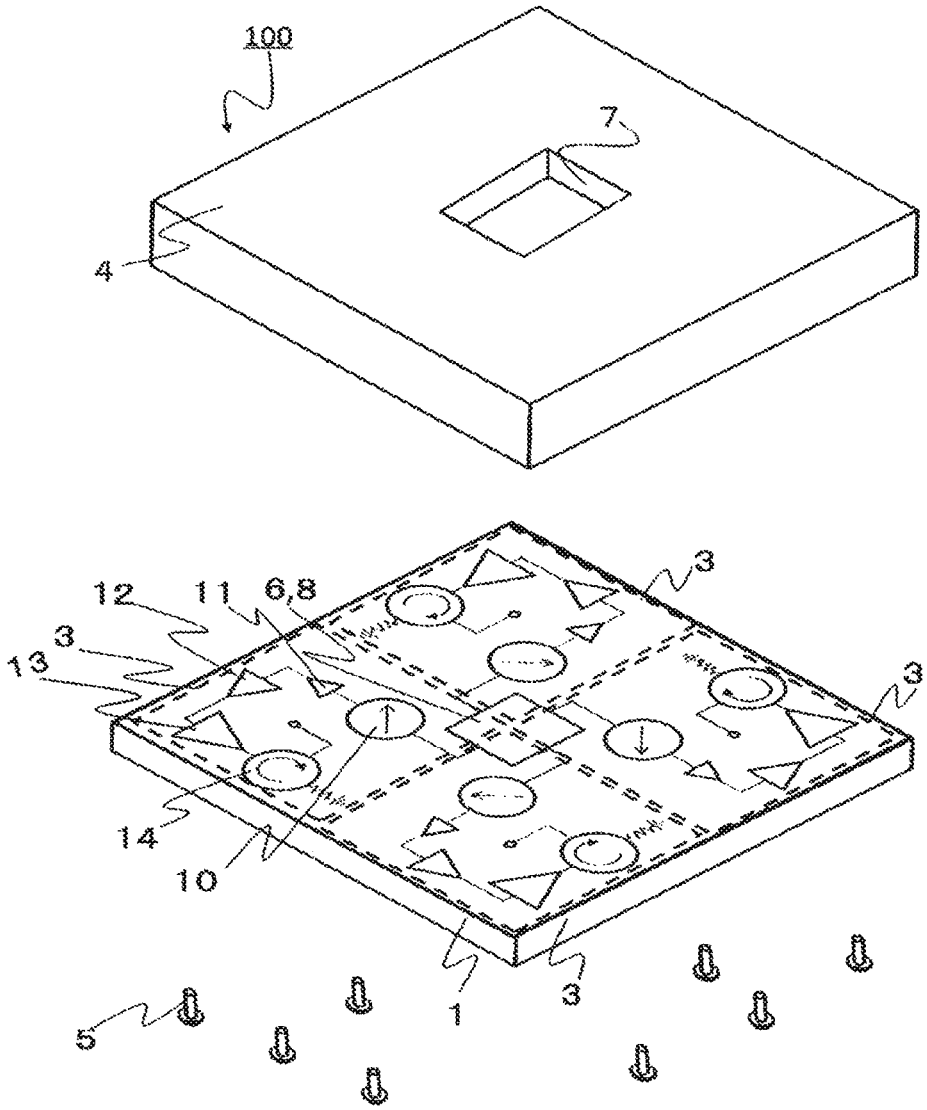
FIG. 3 is an exploded view showing a configuration of the high-frequency antenna module according to the first embodiment.

A structure of a high-frequency antenna module 100 according to a first embodiment of the present disclosure is described with reference to FIGS. 1 to 3. FIG. 1 is a perspective view of a high-frequency antenna module according to the first embodiment of the present disclosure, seen from an antenna side. FIG. 2 is a perspective view of the high-frequency antenna module seen from a metal block side, in the high-frequency antenna module according to the first embodiment. FIG. 3 is an exploded view showing a configuration of the high-frequency antenna module according to the first embodiment. A substrate may be a single-layer substrate.

High-frequency antenna module 100 has an outer shape like a thick square plate. A substrate 1 is a dielectric multilayer substrate having transmission lines in a surface layer and an internal layer and having square-shaped main surfaces. A square whose corners are cut off by a straight line or a curved line is also called a square. Four element antennas 2 are arranged on one main surface of substrate 1. A surface of substrate 1 equipped with electronic components and the like and a surface opposite thereto are called main surfaces. Each element antenna 2 emits an RF (Radio Frequency) signal of several GHz to a space. Each element antenna 2 is a patch antenna. An antenna of another type may be used as long as it has a sufficiently small height.

On the surface of substrate 1 opposite to the surface provided with element antennas 2, four amplification units 3 are arranged to correspond to respective element antennas 2. A metal block 4 is provided to cover a distribution circuit 8, amplification units 3, and the like. Metal block 4 has the same size as that of substrate 1. Substrate 1 is fixed to metal block 4 with screws 5. Substrate 1 may be integrated with metal block 4 by a method other than using screws.

On a substrate 1 side of metal block 4, recesses are provided to form spaces for housing the electronic components. The shape and size of each recess are appropriately determined such that oscillation of amplifiers due to resonance of the space can be suppressed at a used frequency or a determined frequency. Metal block 4 also has functions of electromagnetic shielding and heat dissipation. Metal block 4 is made of a metal having a high thermal conductivity, such as aluminum. Metal block 4 serves as a metal casing configured to house distribution circuit 8 and amplification units 3 between substrate 1 and the metal casing, and dissipate heat generated by heat generating portions of amplification units 3. When heat is dissipated not through the metal block, a block made of resin or the like may be used instead of the metal block. The block made of resin is provided with a conductor film on its surface in order to have the function of electromagnetic shielding.

At the center of a surface of metal block 4 on a side not connected to substrate 1 is provided a through hole 7 for exposing an input port 6 to which an RF signal to be amplified is inputted. Input port 6 is provided on substrate 1 at a position corresponding to through hole 7. Distribution circuit 8 configured to distribute the RF signal to a plurality of (here, four) wires is connected to input port 6. In schematic views such as FIG. 3, input port 6 and distribution circuit 8 are integrally illustrated. The RF signal distributed by distribution circuit 8 is inputted to each amplification unit 3. Four amplification units 3 having the same configuration are rotated by 90 degrees, and are arranged on the side of substrate 1 provided with distribution circuit 8 to be rotationally symmetric about distribution circuit 8. In distribution circuit 8, lengths of wires from input port 6 to input points of amplification units 3 are identical. Distribution circuit 8 is arranged such that its center matches the center of substrate 1. To be precise, amplification units 3 are arranged to be rotationally symmetric with respect to the center of distribution circuit 8. Distribution circuit 8 is also rotationally symmetric with respect to its center.

Figure 4:
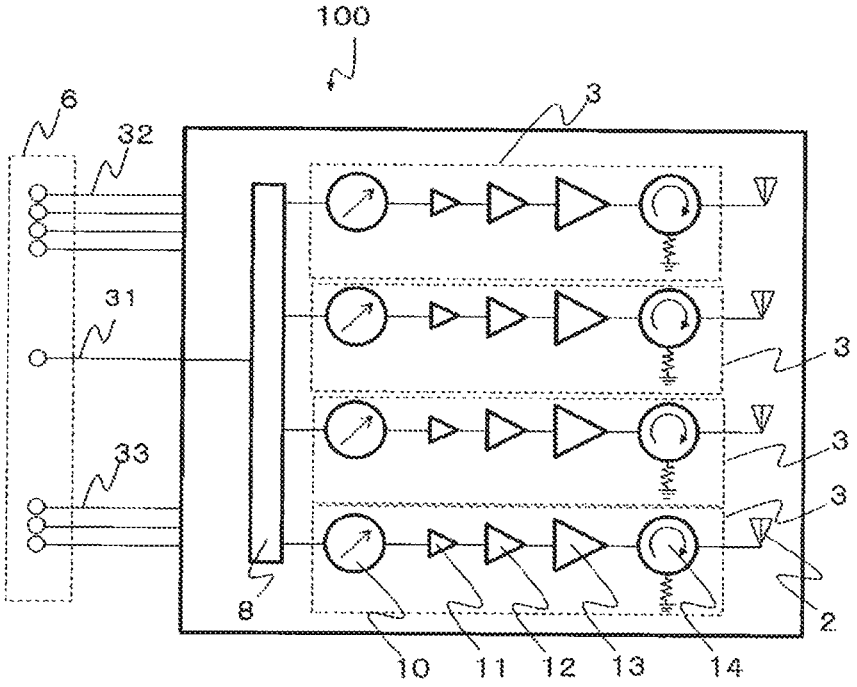
FIG. 4 is a circuit diagram illustrating an electric configuration of the high-frequency antenna module according to the first embodiment.

An electric configuration of high-frequency antenna module 100 is described with reference to FIG. 4. FIG. 4 is a circuit diagram illustrating an electric configuration of the high-frequency antenna module according to the first embodiment. Not only an RF signal line 31 for transmitting the RF signal but also a control signal line 32 and a direct current (DC) power source line 33 are connected to input port 6. At input port 6, the RF signal is connected by a coaxial connector. Each amplification unit 3, to which the RF signal distributed by distribution circuit 8 is inputted, has a phase shifter 10, a first stage amplifier 11, a second stage amplifier 12, a third stage amplifier 13, and an isolator 14 connected in series. Element antennas 2 arranged on the side of substrate 1 opposite to the side provided with amplification units 3 are connected to isolators 14, via through conductors 15 (shown in FIG. 5) which penetrate substrate 1. Power may be fed to element antennas 2 using a power feeding method which adopts electromagnetic coupling, instead of using through conductors 15. Through conductors 15 serve as RF signal supplying portions each configured to supply the RF signal amplified by amplification unit 3 to corresponding element antenna 2.

Phase shifter 10 controls the phase of the RF signal. In each amplification unit 3, the phase of the RF signal can be individually controlled to an arbitrary phase by a control signal inputted through control signal line 32. First stage amplifier 11, second stage amplifier 12, and third stage amplifier 13 amplify the RF signal to a required level. The amplified RF signal is electrically separated by isolator 14 and is supplied to element antenna 2. Element antenna 2 is an antenna configured to emit the RF signal to the space. The number of stages of the cascade-connected amplifiers may be two, or four or more. The number of stages of the amplifiers is appropriately determined depending on the performance of each amplifier and a required amplification degree.

Figure 5:
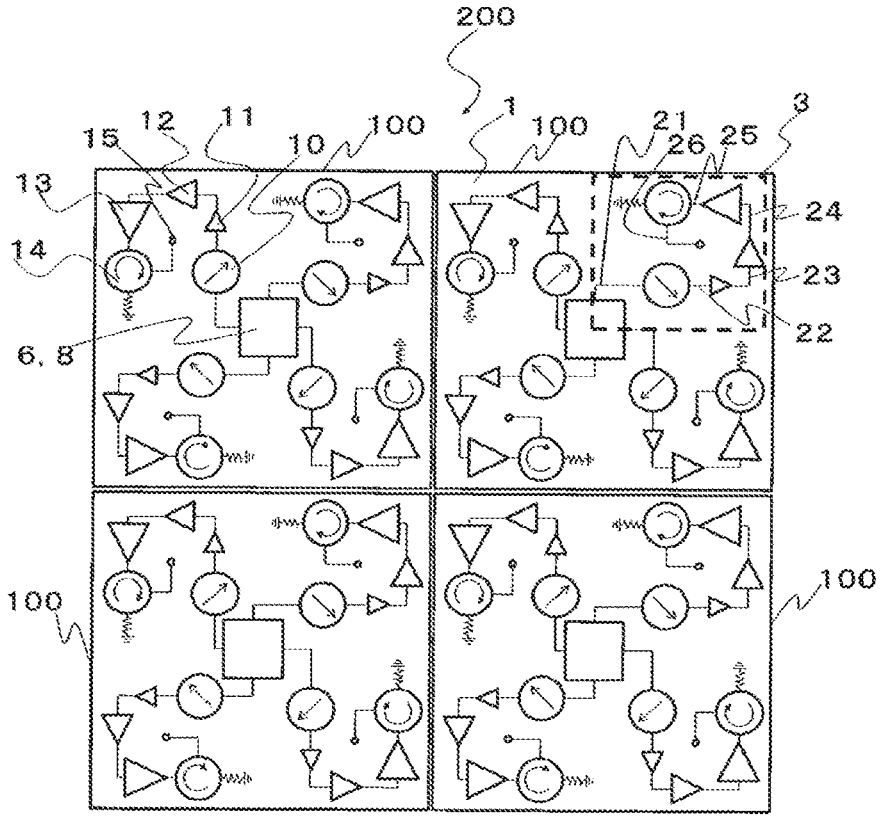
FIG. 5 is a plan view illustrating arrangement of electronic components on substrates of the high-frequency antenna modules according to the first embodiment.

Arrangement of the electronic components within each amplification unit 3 is described with reference to FIG. 5. FIG. 5 is a plan view illustrating arrangement of the electronic components on the substrates of the high-frequency antenna modules according to the first embodiment. FIG. 5 shows a total of four high-frequency antenna modules 100 (in two rows and two columns) arranged to show the positional relation among third stage amplifiers 13, which are amplifiers in the last stage and generate heat most in each amplification unit 3, in adjacent high-frequency antenna modules 100.

A description is given, taking upper right amplification unit 3 in upper right high-frequency antenna module 100 in FIG. 5 as an example. To make the drawing easy to read, the reference numerals of the electronic components are allotted to another amplification unit 3. A wire 21 exiting distribution circuit 8 extends upward in the drawing, turns to the right at a position which is about 25% of the length of amplification unit 3 and then extends, and enters phase shifter 10. A wire 22 extending rightward from phase shifter 10 enters first stage amplifier 11. A wire 23 extending rightward from first stage amplifier 11 turns upward near an end portion of substrate 1, and enters second stage amplifier 12. A wire 24 extending upward from second stage amplifier 12 turns to the left near the upper right corner of substrate 1, and enters third stage amplifier 13. A wire 25 extending leftward from third stage amplifier 13 enters isolator 14. A wire 26 extending downward from isolator 14 turns to the right, and is connected to through conductor 15 provided substantially at the center of amplification unit 3.

In four amplification units 3, paths from distribution circuit 8 to element antennas 2 have the same configuration, and they are only different in orientation. Accordingly, lengths of the wires from input port 6 to through conductors 15 are identical in respective amplification units 3. Since respective through conductors 15 of four amplification units 3 are arranged at positions which are rotationally symmetric with respect to distribution circuit 8, element antennas 2 are also arranged at positions which are rotationally symmetric with respect to distribution circuit 8. As a result, lengths of the wires from input port 6 to element antennas 2 are identical in respective amplification units 3.

In the exemplary arrangement shown in FIG. 5, third stage amplifiers 13 in high-frequency antenna module 100 are arranged at corner portions of substrate 1. A corner portion is a range which includes a corner and is defined from the corner. Accordingly, respective third stage amplifiers 13 within high-frequency antenna module 100 are separated from one another at an interval which is close to the width of substrate 1. Further, third stage amplifiers 13 in adjacent high-frequency antenna modules 100 are adjacent to one another. Third stage amplifiers 13, which are the amplifiers in the last stage, entirely or partly serve as heat generating portions which generate most of the heat generated in high-frequency antenna module 100. When the number of stages of the amplifiers is not three, the amplifiers in the last stage entirely or partly serve as heat generating portions.

Figure 6:
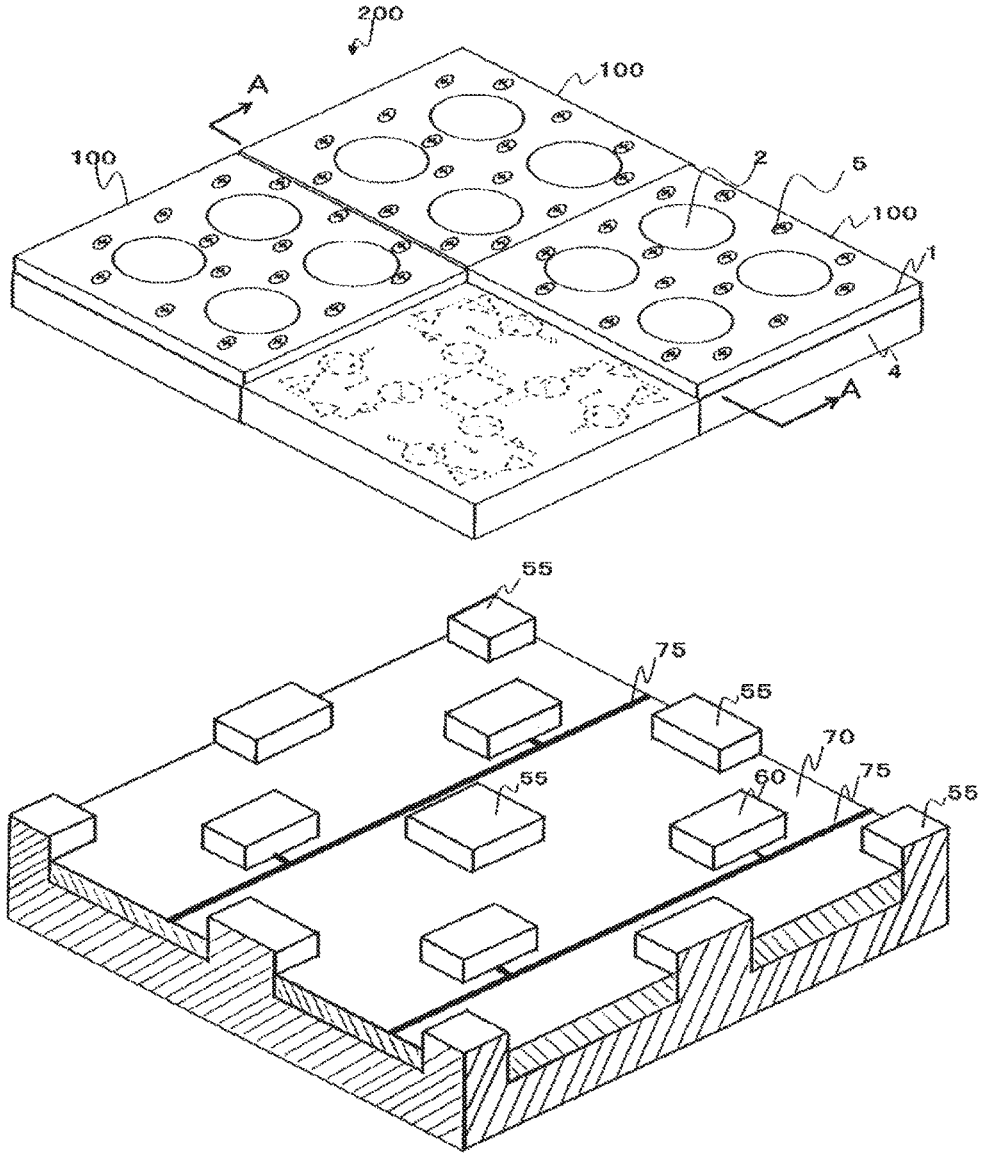
FIG. 6 is an exploded view of an array antenna device according to the first embodiment.
Figure 7:
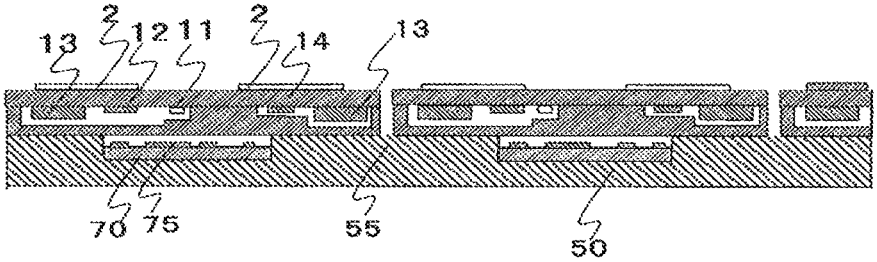
FIG. 7 is a cross sectional view of the array antenna device according to the first embodiment, taken along a line A-A shown in FIG. 6.

High-frequency antenna modules 100 are arranged in a two-dimensional array to constitute an array antenna device 200. FIG. 6 is an exploded view of an array antenna device according to the first embodiment. FIG. 7 is a cross sectional view of the array antenna device according to the first embodiment, taken along a line A-A shown in FIG. 6. FIG. 6 shows the portion of a total of four high-frequency antenna modules 100 (in two rows and two columns) in a cut-out manner. Front left high-frequency antenna module 100 is shown with substrate 1 being removed therefrom, to show arrangement of the electronic components on the side of substrate 1 not provided with element antennas 2.

Array antenna device 200 includes a plurality of high-frequency antenna modules 100 arranged in a two-dimensional array, a plate-like metal base 50, and a base substrate 70 having connectors 60 connected to input ports 6 of high-frequency antenna modules 100. The number of connectors 60 is the same as the number of high-frequency antenna modules 100. Metal base 50 serves as a module holding portion configured to hold the plurality of high-frequency antenna modules 100 and base substrate 70.

Metal base 50 has protruding portions 55 in the shape of a quadrangular prism which each come into contact with metal blocks 4 to include corner portions of metal blocks 4 of four high-frequency antenna modules 100 which share a corner. Protruding portions 55 transfer heat generated in high-frequency antenna modules 100 and transferred to metal blocks 4 mainly through substrates 1, from metal blocks 4 to metal base 50. Thereby, protruding portions 55 cool high-frequency antenna modules 100. That is, protruding portions 55 serve as cooling portions configured to cool high-frequency antenna modules 100, i.e., metal blocks 4. A pipe may be provided inside each protruding portion 55, and cooling may be performed using a coolant passing through the inside of the pipes. Fins may be provided to metal base 50 to perform natural air cooling or forced air cooling. The fins may be provided in a concentrated manner at positions corresponding to protruding portions 55. Protruding portions 55 may be provided separately from metal base 50, and metal base 50 may hold protruding portions 55. Also when protruding portions 55 are integrated with metal base 50, it is considered that metal base 50 holds protruding portions 55.

Base substrate 70 is provided with openings at positions corresponding to protruding portions 55. Protruding portions 55 pass through the openings in base substrate 70, and come into contact with metal blocks 4. A surface of base substrate 70 is provided with wires 75 for distributing the RF signal line, the DC power source line, and the control signal line to connectors 60. Wires 75 are provided such that lengths of wires from a power feeding source not shown to connectors 60 are identical.

Operation of array antenna device 200 is described. The RF signal, DC power, and the control signal are supplied from a power feeding circuit of array antenna device 200 to input ports 6 of high-frequency antenna modules 100 via wires 75 and connectors 60. The RF signal is distributed by each distribution circuit 8, and the distributed RF signal is amplified by each amplification unit 3 and emitted from each element antenna 2 to the space. Since lengths of wires from the power feeding circuit to all element antennas 2 are set to be identical, when the phase is controlled by the control signal such that the same phase is achieved in all element antennas 2, electric waves having the same phase are emitted from all element antennas 2 to the space. When the phase is controlled by the control signal, the phase of an electric wave emitted by element antenna 2 becomes equal to a phase instructed to phase shifter 10 in amplification unit 3 which supplies the RF signal to that element antenna 2.

Since four element antennas 2 share one input port 6, a mounting area can be reduced. Since amplification units 3 and element antennas 2 are arranged to be rotationally symmetric about distribution circuit 8, special processing such as excess length processing is not required on substrate 1, and the lengths of the wires from input port 6 to element antennas 2 can be set to be identical. The antennas are arranged on the back surface of the substrate, and there is no need to separate a circuit substrate and an antenna substrate. As a result, a smaller-sized and thinner high-frequency antenna module can be achieved. Further, since special processing such as excess length processing is not required on the substrate, the degree of freedom in designing the substrate is improved.

Since protruding portions 55 serving as the cooling portions configured to come into contact with metal blocks 4 to cool metal blocks 4 are provided, high-frequency antenna modules 100 can be cooled efficiently. Since each protruding portion 55 is provided at a position corresponding to the heat generating portions of the plurality of adjacent high-frequency antenna modules 100, the number of protruding portions 55 can be reduced. Since the number of protruding portions 55 is reduced and the size of one protruding portion is large, it is also possible to use a cooling portion having a higher cooling efficiency instead of protruding portion 55. By bringing each protruding portion 55 into contact with metal blocks 4 at the position corresponding to the heat generating portions, protruding portions 55 can cool metal blocks 4 efficiently. The position corresponding to the heat generating portions is a position immediately below each heat generating portion, or a position where each metal block comes into contact with each substrate at a location close to each heat generating portion, on a metal base side.

The arrangement of the electronic components within each amplification unit can be designed freely. The substrate may have main surfaces in another shape such as a triangle, a hexagon, or the like, instead of a square, as long as the shape is rotationally symmetric. The number of distribution by the distribution circuit is not limited to four.

The above description also applies to other embodiments.

Second Embodiment

Figure 8:
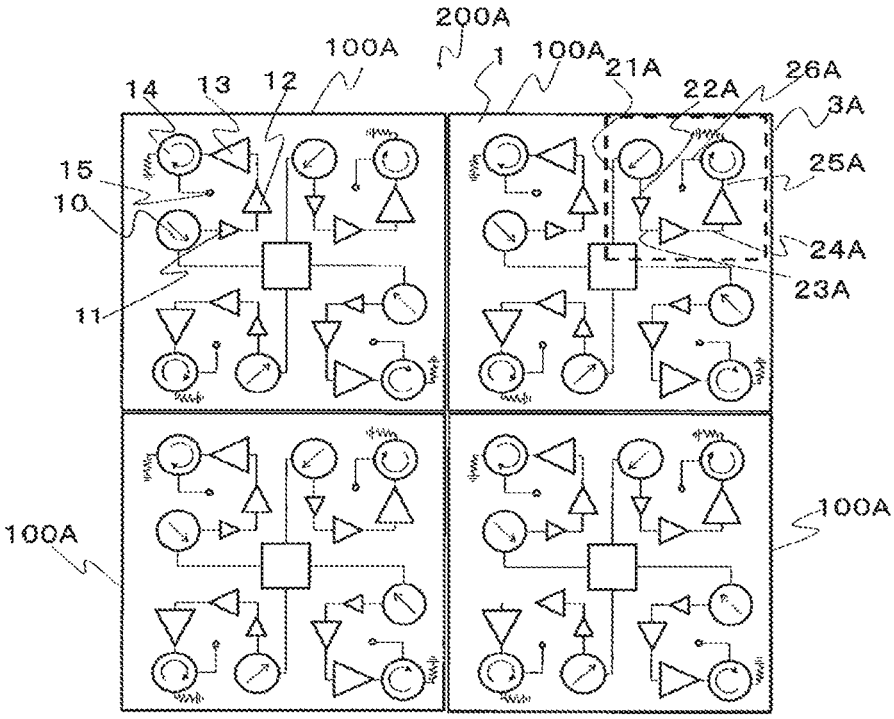
FIG. 8 is a plan view illustrating arrangement of electronic components on substrates of high-frequency antenna modules according to a second embodiment of the present disclosure.

A second embodiment illustrates a case where the arrangement of the electronic components on the substrates of the high-frequency antenna modules is modified. FIG. 8 is a plan view illustrating arrangement of electronic components on substrates of high-frequency antenna modules according to the second embodiment of the present disclosure. A high-frequency antenna module 100A of the second embodiment is the same as high-frequency antenna module 100 of the first embodiment in appearance and electric configuration thereof. In FIG. 8, components which are identical or equal to those in FIGS. 1 to 7 are designated by the same reference numerals, and the description thereof is not repeated.

A description is given, taking an upper right amplification unit 3A in upper right high-frequency antenna module 100A in FIG. 8 as an example. To make the drawing easy to read, the reference numerals of the electronic components are allotted to another amplification unit 3A. A wire 21A exiting distribution circuit 8 extends upward in the drawing, turns to the right by 90 degrees near an end portion of substrate 1, and enters phase shifter 10. A wire 22A extending downward from phase shifter 10 enters first stage amplifier 11. A wire 23A extending downward from first stage amplifier 11 turns to the right near distribution circuit 8, and enters second stage amplifier 12. A wire 24A extending rightward from second stage amplifier 12 turns upward along the way, and enters third stage amplifier 13. A wire 25A extending upward from third stage amplifier 13 enters isolator 14. A wire 26A extending leftward from isolator 14 turns downward, and is connected to through conductor 15 provided substantially at the center of amplification unit 3.

In the exemplary arrangement shown in FIG. 8, in each high-frequency antenna module 100A, third stage amplifiers 13 in respective amplification units 3 have a distance therebetween which is approximately half of the length of substrate 1. Further, third stage amplifiers 13 in adjacent high-frequency antenna modules 100A also have a distance therebetween which is approximately half of the length of substrate 1. Here, it is assumed that third stage amplifiers 13 entirely serve as heat generating portions. The heat generating portions are arranged at positions where a distance between the heat generating portions is more than or equal to a determined distance such as 40% of the length of the substrate, for example, and a distance between each heat generating portion and an end of the substrate is more than or equal to a determined distance such as 20% of the length of the substrate, for example.

Although not shown, an array antenna device 200A according to the second embodiment has a metal base 50A and a base substrate 70A. When compared with metal base 50, metal base 50A has protruding portions 55A in the shape of a quadrangular prism arranged at positions immediately below the heat generating portions, in a number that is four times the number of protruding portions 55 in metal base 50. Each protruding portions 55A has a cross section in the shape of a square, and the length of one side of the square is approximately half of that in protruding portions 55. Base substrate 70A is provided with openings at positions corresponding to protruding portions 55A.

Array antenna device 200A operates in the same way as array antenna device 200. A smaller-sized and thinner high-frequency antenna module can be achieved.

Heat is transferred from protruding portions 55A to metal base 50A. Since the number of protruding portions 55A is four times the number of protruding portions 55, the heat is transferred to metal base 50A in a dispersed manner. Accordingly, protruding portions 55A can perform cooling for base substrate 50A by natural air cooling or forced air cooling, more efficiently when compared with the first embodiment.

Third Embodiment

Figure 9:
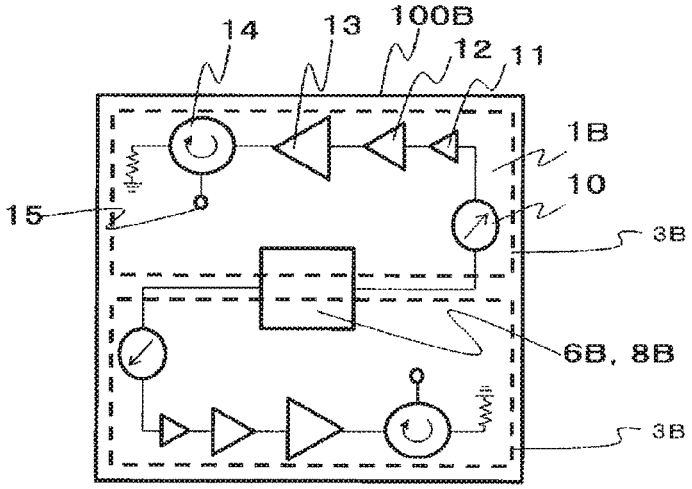
FIG. 9 is a plan view illustrating arrangement of electronic components on a substrate of a high-frequency antenna module according to a third embodiment of the present disclosure.

A third embodiment illustrates a case where a high-frequency antenna module has two amplification units. FIG. 9 is a plan view illustrating arrangement of electronic components on a substrate of a high-frequency antenna module according to the third embodiment of the present disclosure. In FIG. 9, components which are identical or equal to those in FIGS. 1 to 7 are designated by the same reference numerals, and the description thereof is not repeated.

In a high-frequency antenna module 100B according to the third embodiment, an input port 6B and a distribution circuit 8B are provided at the center of a square substrate 1B. High-frequency antenna module 100B has two amplification units 3B, and third stage amplifiers 13 are arranged above and below distribution circuit 8B in the drawing. Two element antennas 2 exist on a back surface of substrate 1B.

Figure 10:
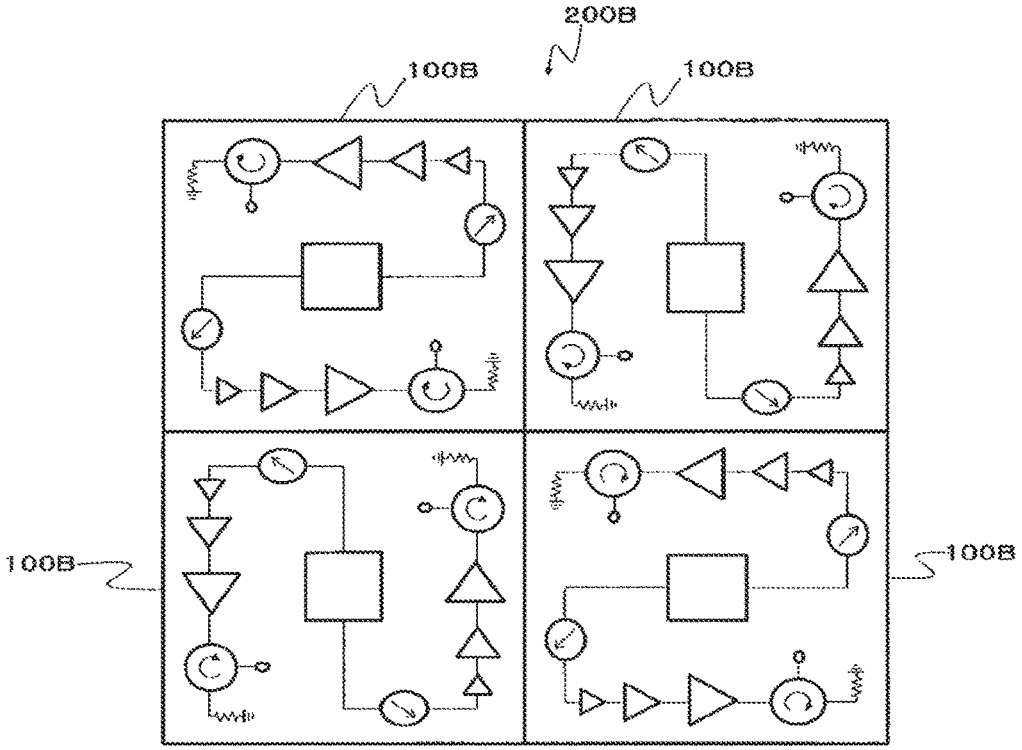
FIG. 10 is a plan view showing one example where the high-frequency antenna modules according to the third embodiment are arranged in an array.

FIG. 10 is a plan view showing one example where the high-frequency antenna modules according to the third embodiment are arranged in an array. In FIG. 10, components which are identical or equal to those in FIGS. 1 to 7 are designated by the same reference numerals, and the description thereof is not repeated. FIG. 10 illustrates a case where high-frequency antenna modules 100B are arranged such that third stage amplifiers 13 are not adjacent to one another. Adjacent high-frequency antenna modules 100B are arranged in orientations different from one another by 90 degrees.

An array antenna device 200B including high-frequency antenna modules 100B arranged as shown in FIG. 10 operates in the same way as array antenna device 200, and has the same effect as that of array antenna device 200.

Figure 11:
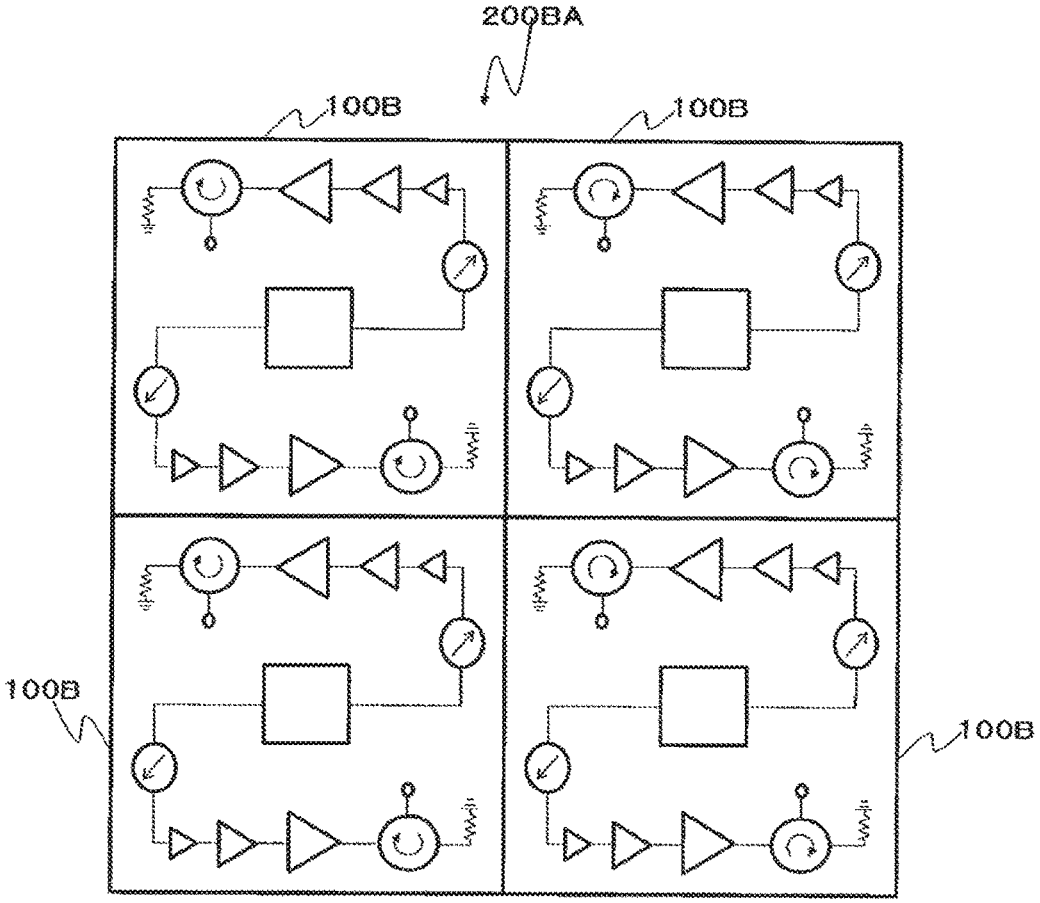
FIG. 11 is a plan view showing another example where the high-frequency antenna modules according to the third embodiment are arranged in an array.

FIG. 11 is a plan view showing another example where the high-frequency antenna modules according to the third embodiment are arranged in an array. In FIG. 11, components which are identical or equal to those in FIGS. 1 to 7 are designated by the same reference numerals, and the description thereof is not repeated. FIG. 11 illustrates a case where high-frequency antenna modules 100B are arranged such that third stage amplifiers 13 are adjacent to one another. All high-frequency antenna modules 100B are arranged in the same orientation. Since high-frequency antenna modules 100B are arranged in the same orientation, the shape of the substrate is not limited to a square, and may be a rectangle, a parallelogram, or the like. The shape of the substrate may be any quadrangle which is rotationally symmetric at a rotation of 180 degrees.

An array antenna device 200BA including high-frequency antenna modules 100B arranged as shown in FIG. 11 operates in the same way as array antenna device 200A, and has the same effect as that of array antenna device 200A.

Fourth Embodiment

Figure 12:
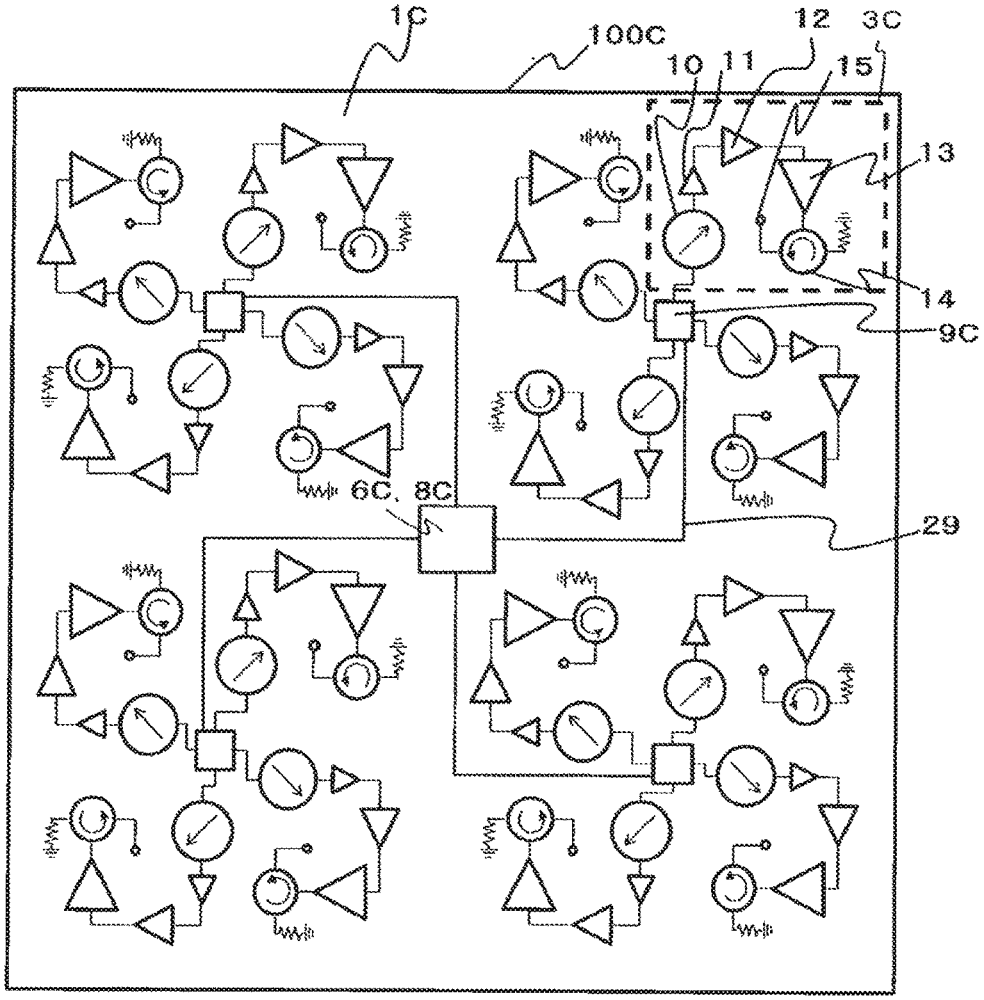
FIG. 12 is a plan view illustrating arrangement of electronic components on a substrate of a high-frequency antenna module according to a fourth embodiment of the present disclosure.

A fourth embodiment illustrates a case where a high-frequency antenna module has 16 amplification units. FIG. 12 is a plan view illustrating arrangement of electronic components on a substrate of a high-frequency antenna module according to the fourth embodiment of the present disclosure. In FIG. 12, components which are identical or equal to those in FIGS. 1 to 7 are designated by the same reference numerals, and the description thereof is not repeated.

On a substrate 1C of a high-frequency antenna module 100C according to the fourth embodiment, there are one input port 6C, one primary distribution circuit 8C, four wires 29 between distribution circuits, four secondary distribution circuits 9C, and 16 amplification units 3C. Primary distribution circuit 8C distributes an RF signal inputted to input port 6C to four wires 29 between the distribution circuits. Each wire 29 between the distribution circuits outputs the RF signal inputted from primary distribution circuit 8C, to secondary distribution circuit 9C. Each secondary distribution circuit 9C distributes the RF signal inputted through wire 29 between the distribution circuits, and outputs the RF signal to four amplification units 3C. On a back surface of substrate 1C, there are 16 element antennas 2 at positions corresponding to 16 amplification units 3C.

The arrangement of the electronic components within each amplification unit 3C is the same as that in amplification unit 3, and may be the same as that in amplification unit 3A. Further, the arrangement of one secondary distribution circuit 9C and four amplification units 3C each configured to amplify the RF signal distributed from secondary distribution circuit 9C is the same as the arrangement of distribution circuit 8 and amplification units 3.

In primary distribution circuit 8C, lengths of wires from an input point of the RF signal to output points after distribution are identical. In all secondary distribution circuits 9C, lengths of wires from an input point of the RF signal to output points after distribution are identical. All wires 29 between the distribution circuits have an identical wire length. Lengths of wires are identical in all amplification units 3C. Therefore, lengths of the wires from input port 6C to element antennas 2 to which respective amplification units 3C are connected are all identical.

Although not shown, an array antenna device 200C according to the fourth embodiment has a plurality of high-frequency antenna modules 100C arranged in a two-dimensional array, a metal base 50C, and a base substrate 70C.

Array antenna device 200C operates in the same way as array antenna device 200. A smaller-sized and thinner high-frequency antenna module can be achieved. Since 16 element antennas 2 correspond to one input port 6C, the effect of sharing the input port is greater than that in the case of high-frequency antenna module 100.

Fifth Embodiment

Figure 13:
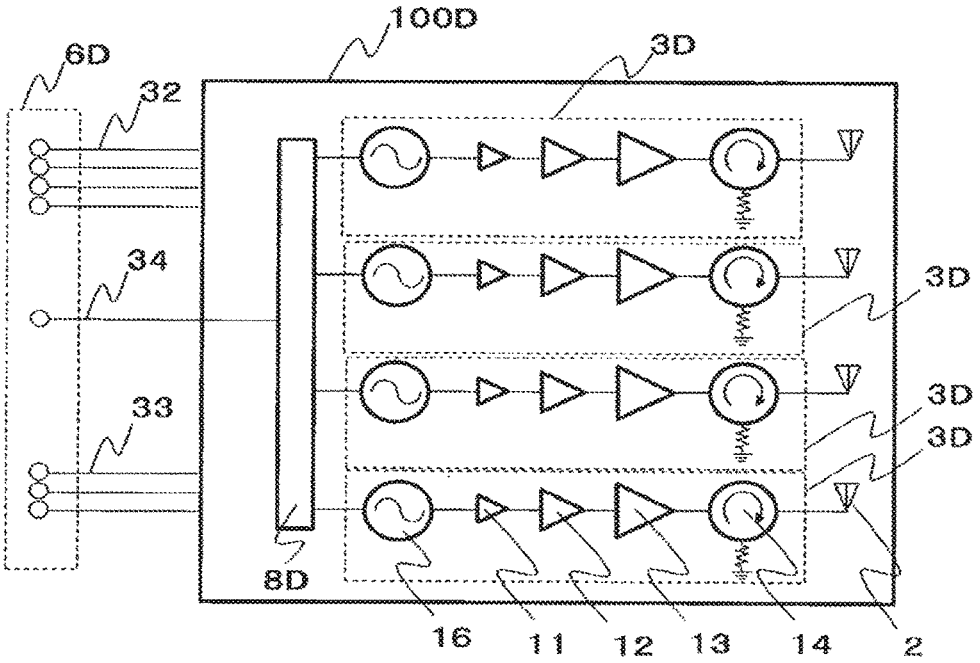
FIG. 13 is a circuit diagram illustrating an electric configuration of a high-frequency antenna module according to a fifth embodiment of the present disclosure.

A fifth embodiment illustrates a case where the second embodiment is modified such that a high-frequency antenna module does not have phase shifters but has PLL (Phased Lock Loop) circuits. FIG. 13 is a circuit diagram illustrating an electric configuration of a high-frequency antenna module according to the fifth embodiment of the present disclosure. In FIG. 13, components which are identical or equal to those in FIGS. 1 to 7 are designated by the same reference numerals, and the description thereof is not repeated.

A high-frequency antenna module 100D according to the fifth embodiment has an input port 6D, a distribution circuit 8D, amplification units 3D, and element antennas 2. Instead of RF signal line 31, a reference signal line 34 for transmitting a reference signal (also referred to as a reference clock signal) of several MHz to several tens of MHz is connected to input port 6D. Distribution circuit 8D distributes the reference signal. The distributed reference signal is inputted to each amplification unit 3D. Each amplification unit 3D has a PLL circuit 16, first stage amplifier 11, second stage amplifier 12, third stage amplifier 13, and isolator 14 connected in series. PLL circuit 16 has an oscillator therein, receives the control signal and the reference signal, and outputs an RF signal of several GHz set to have an arbitrary phase. PLL circuit 16 is an RF signal generation circuit configured to generate the RF signal based on the reference signal.

Figure 14:
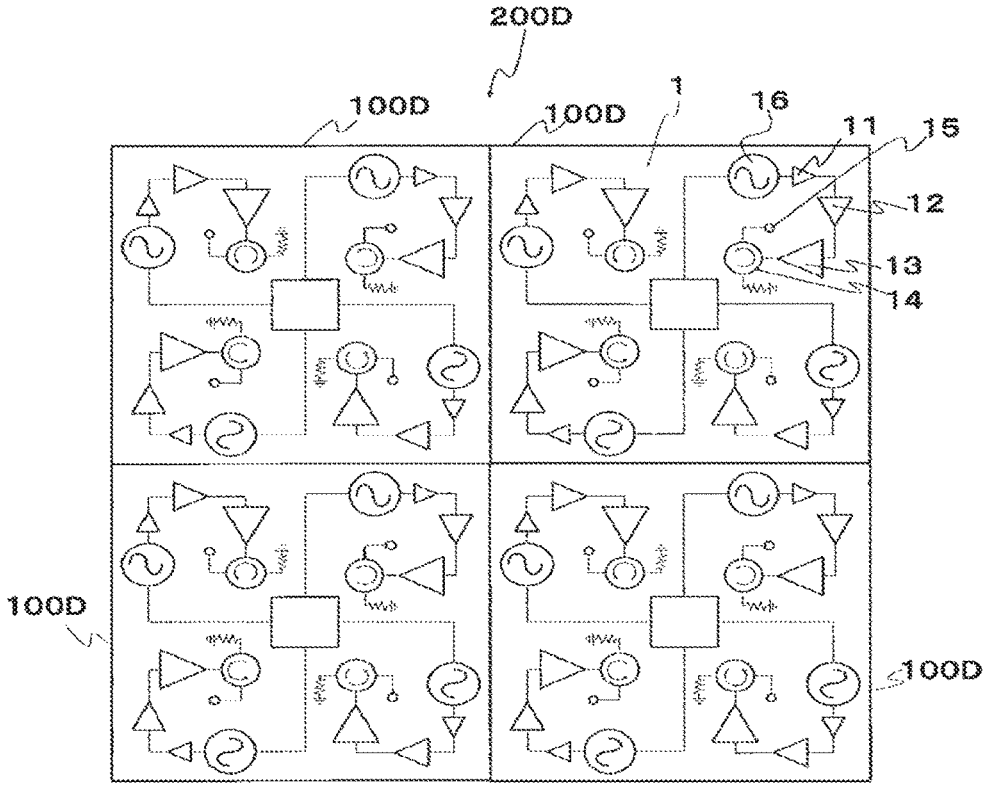
FIG. 14 is a plan view illustrating arrangement of electronic components on substrates of the high-frequency antenna modules according to the fifth embodiment.

FIG. 14 is a plan view illustrating arrangement of electronic components on substrates of the high-frequency antenna modules according to the fifth embodiment. In FIG. 14, components which are identical or equal to those in FIGS. 1 to 7 are designated by the same reference numerals, and the description thereof is not repeated. When compared with the arrangement in FIG. 8 in the case of the second embodiment, the arrangement in FIG. 14 is different in that PLL circuits 16 are arranged at the positions of phase shifters 10. The positions at which third stage amplifiers 13 are arranged are identical to those in FIG. 8. Lengths of wires from input port 6D to element antennas 2 are identical in respective amplification units 3D.

In an array antenna device 200D according to the fifth embodiment, the reference signal and the control signal are inputted, the RF signal is generated from the reference signal in each PLL circuit 16, and the RF signal is emitted from each element antenna 2 to the space.

Since the high-frequency antenna module contains oscillators, low-frequency control signal and reference signal are inputted to the high-frequency antenna module. There is no need to use coaxial connectors for the RF signal for the input ports and the connectors, and thus the input ports and the connectors can be manufactured inexpensively.

The reference signal is transmitted from input port 6D to each PLL circuit 16. The reference signal has a wavelength longer than that of the RF signal. Accordingly, a phase difference caused by an identical difference in wire length is smaller in the case of the reference signal, than that in the case of the RF signal. Therefore, an allowable error of wire lengths from input port 6D to PLL circuits 16, which is required to make the phase difference less than or equal to an allowable maximum value, is longer in the case of the reference signal, than that in the case of the RF signal.

Sixth Embodiment

Figure 15:
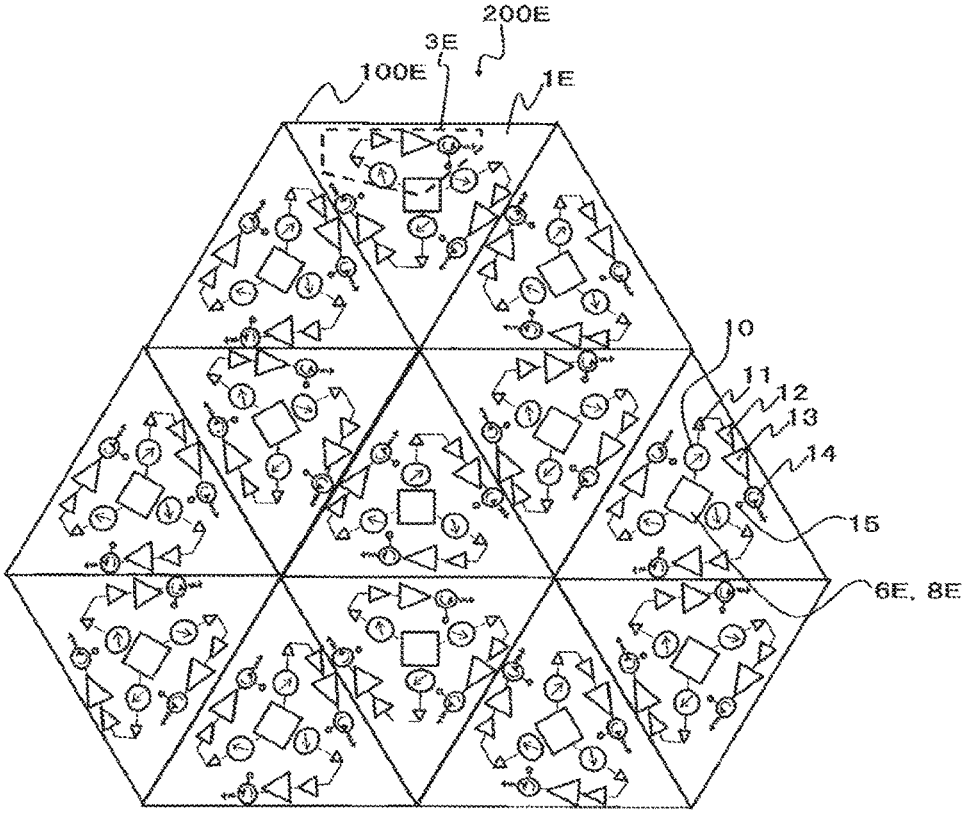
FIG. 15 is a plan view illustrating arrangement of electronic components on substrates of high-frequency antenna modules according to a sixth embodiment of the present disclosure.

A sixth embodiment illustrates a case where heat generating portions of adjacent high-frequency antenna modules are arranged on regular triangular substrates so as not to be adjacent to one another. FIG. 15 is a plan view illustrating arrangement of electronic components on substrates of high-frequency antenna modules according to the sixth embodiment of the present disclosure. In FIG. 15, components which are identical or equal to those in FIGS. 1 to 7 are designated by the same reference numerals, and the description thereof is not repeated.

On a regular triangular substrate 1E of each high-frequency antenna module 100E according to the sixth embodiment, one input port 6E, one distribution circuit 8E, and three amplification units 3E are arranged. Input port 6E and distribution circuit 8E are arranged near the center of gravity of a triangle. In each amplification unit 3E, phase shifter 10 and first stage amplifier 11 are arranged toward a vertex of the triangle, and second stage amplifier 12, third stage amplifier 13, and isolator 14 are arranged along a side of the triangle. Through conductor 15 is arranged on a side of isolator 14 away from the side of the triangle.

An array antenna device 200E including high-frequency antenna modules 100E arranged as shown in FIG. 15 operates in the same way as array antenna device 200A, and has the same effect as that of array antenna device 200A.

Seventh Embodiment

Figure 16:
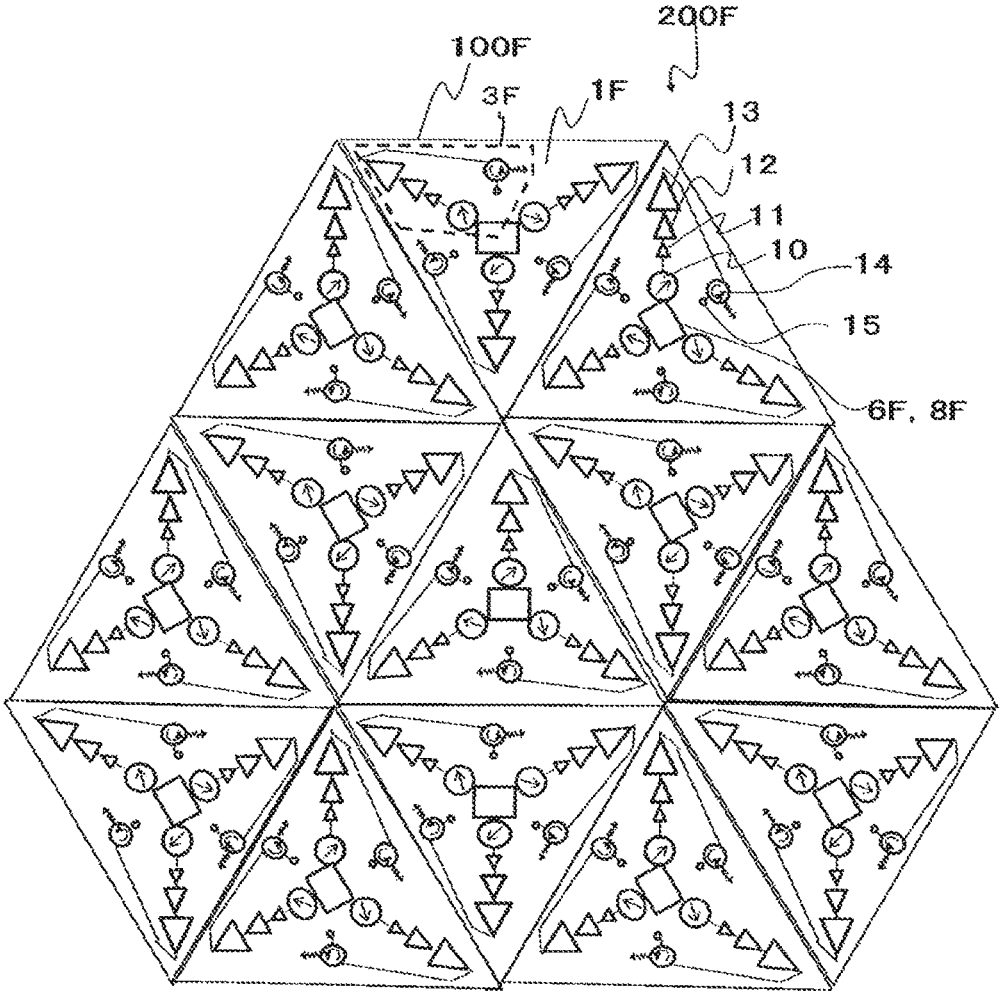
FIG. 16 is a plan view illustrating arrangement of electronic components on substrates of high-frequency antenna modules according to a seventh embodiment of the present disclosure.

A seventh embodiment illustrates a case where heat generating portions of adjacent high-frequency antenna modules are arranged on regular triangular substrates so as to be adjacent to one another. FIG. 16 is a plan view illustrating arrangement of electronic components on substrates of high-frequency antenna modules according to the seventh embodiment of the present disclosure. In FIG. 16, components which are identical or equal to those in FIGS. 1 to 7 are designated by the same reference numerals, and the description thereof is not repeated.

On a regular triangular substrate 1F of each high-frequency antenna module 100F according to the seventh embodiment, one input port 6F, one distribution circuit 8F, and three amplification units 3F are arranged. Input port 6F and distribution circuit 8F are arranged near the center of gravity of a triangle. In each amplification unit 3F, phase shifter 10, first stage amplifier 11, second stage amplifier 12, and third stage amplifier 13 are arranged toward a vertex of the triangle. Isolator 14 is arranged substantially at the center of a side of the triangle. Through conductor 15 is arranged on a side of isolator 14 away from the side of the triangle.

An array antenna device 200F including high-frequency antenna modules 100F arranged as shown in FIG. 16 operates in the same way as array antenna device 200, and has the same effect as that of array antenna device 200.

Eighth Embodiment

Figure 17:
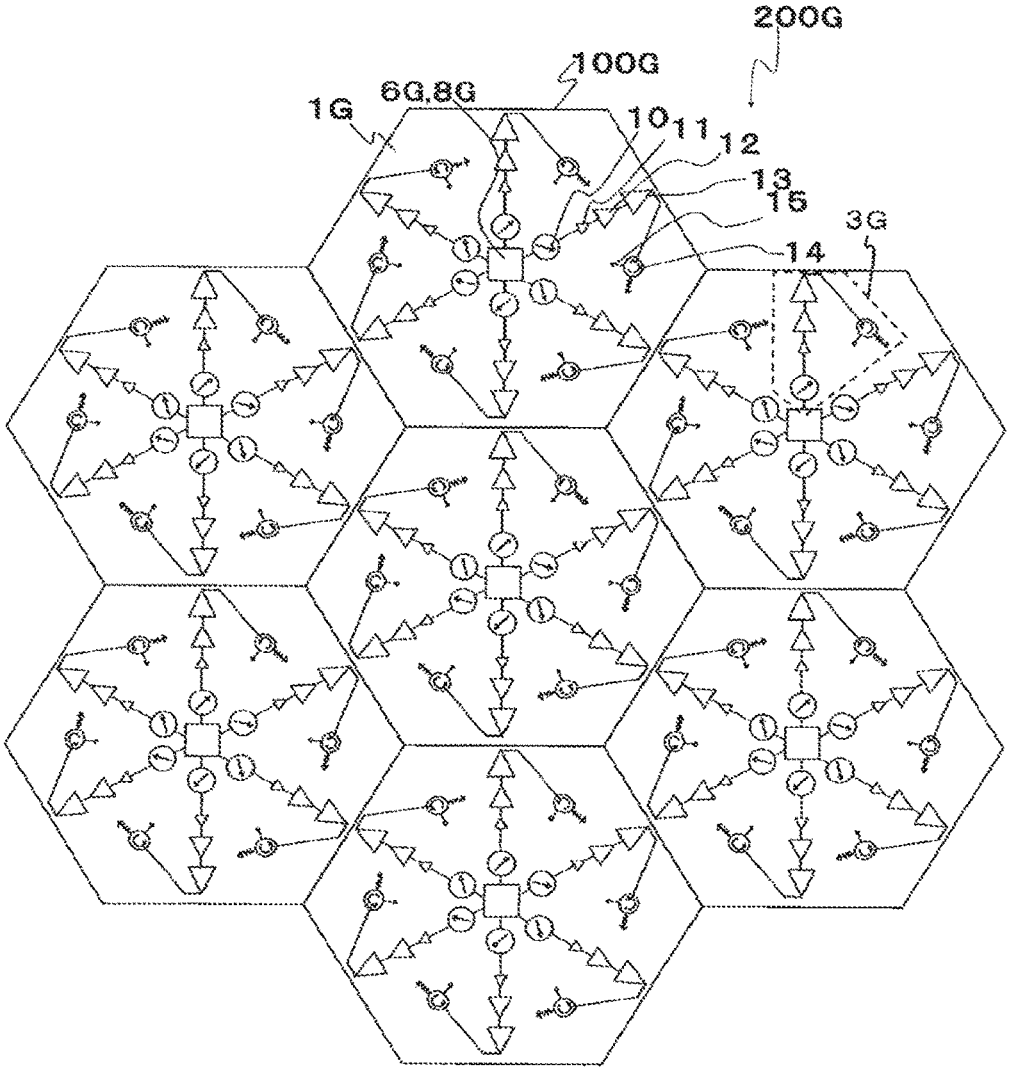
FIG. 17 is a plan view illustrating arrangement of electronic components on substrates of high-frequency antenna modules according to an eighth embodiment of the present disclosure.

An eighth embodiment illustrates a case where heat generating portions of adjacent high-frequency antenna modules are arranged on regular hexagonal substrates so as not to be adjacent to one another. FIG. 17 is a plan view illustrating arrangement of electronic components on substrates of high-frequency antenna modules according to the eighth embodiment of the present disclosure. In FIG. 17, components which are identical or equal to those in FIGS. 1 to 7 are designated by the same reference numerals, and the description thereof is not repeated.

On a regular hexagonal substrate 1G of each high-frequency antenna module 100G according to the eighth embodiment, one input port 6G, one distribution circuit 8G, and six amplification units 3G are arranged. Input port 6G and distribution circuit 8G are arranged near the center of gravity of a hexagon. In each amplification unit 3G, phase shifter 10 and first stage amplifier 11 are arranged toward a vertex of the hexagon, and second stage amplifier 12, third stage amplifier 13, and isolator 14 are arranged along a side of the hexagon. Through conductor 15 is arranged on a side of isolator 14 away from the side of the hexagon.

The number of amplification units may also be two or three. The same applies to the following embodiment.

An array antenna device 200G including high-frequency antenna modules 100G arranged as shown in FIG. 17 operates in the same way as array antenna device 200A, and has the same effect as that of array antenna device 200A.

Ninth Embodiment

Figure 18:
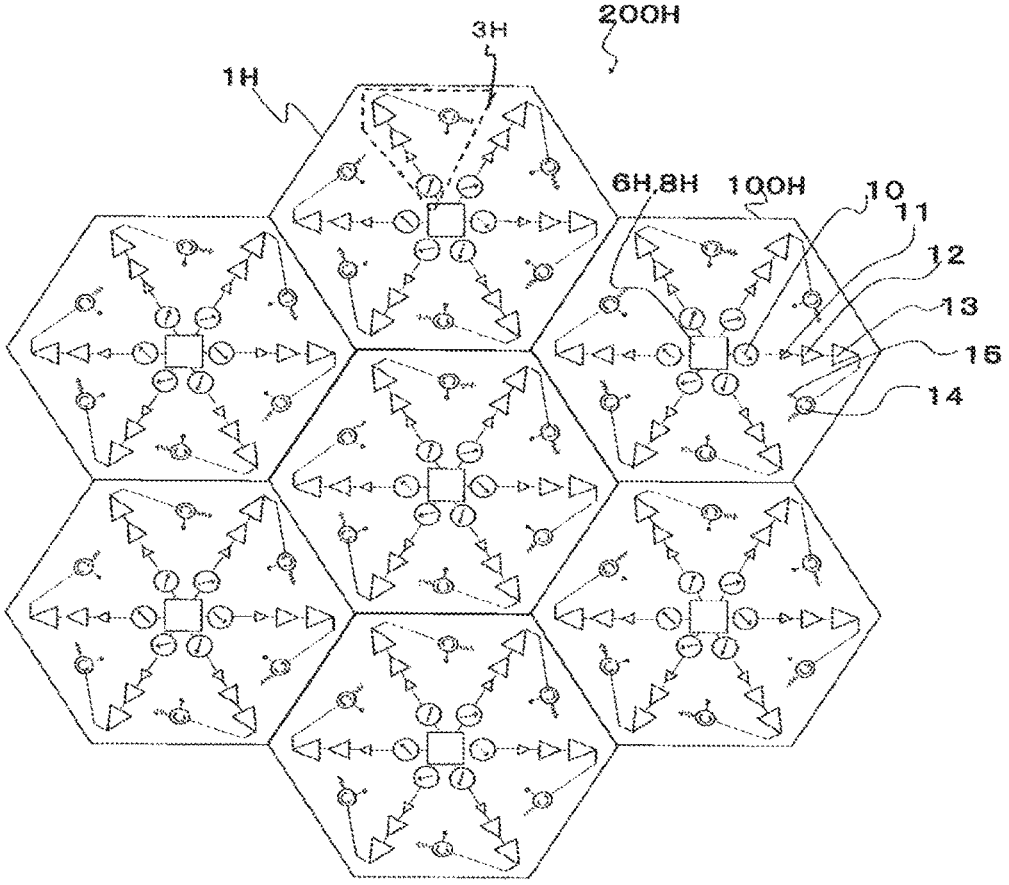
FIG. 18 is a plan view illustrating arrangement of electronic components on substrates of high-frequency antenna modules according to a ninth embodiment of the present disclosure.

A ninth embodiment illustrates a case where heat generating portions of adjacent high-frequency antenna modules are arranged on regular hexagonal substrates so as to be adjacent to one another. FIG. 18 is a plan view illustrating arrangement of electronic components on substrates of high-frequency antenna modules according to the ninth embodiment of the present disclosure. In FIG. 18, components which are identical or equal to those in FIGS. 1 to 7 are designated by the same reference numerals, and the description thereof is not repeated.

On a regular hexagonal substrate 1H of each high-frequency antenna module 100H according to the ninth embodiment, one input port 6H, one distribution circuit 8H, and six amplification units 3H are arranged. Input port 6H and distribution circuit 8H are arranged near the center of gravity of a hexagon. In each amplification unit 3H, phase shifter 10, first stage amplifier 11, second stage amplifier 12, and third stage amplifier 13 are arranged toward a vertex of the hexagon. Isolator 14 is arranged along a substantial center of a side of the hexagon. Through conductor 15 is arranged on a side of isolator 14 away from the side of the hexagon.

An array antenna device 200H including high-frequency antenna modules 100H arranged as shown in FIG. 18 operates in the same way as array antenna device 200A, and has the same effect as that of array antenna device 200A.

In the present disclosure, the embodiments can be freely combined, or can each be modified or omitted, within the scope of the spirit of the disclosure.

REFERENCE SIGNS LIST

100: high-frequency antenna module (first embodiment),
1: substrate,
2: element antenna,
3: amplification unit,
4: metal block,
5: screw,
6: input port,
7: through hole;
8: distribution circuit,
10: phase shifter,
11: first stage amplifier,
12: second stage amplifier,
13: third stage amplifier (heat generating portion),
14: isolator,
15: through conductor (RF signal supplying portion),
21: wire,
22: wire,
23: wire,
24: wire,
25: wire,
26: wire,
31: RF signal line,
32: control signal line,
33: DC power source line,
200: array antenna device,
50: metal base,
55: protruding portion (cooling portion),
60: connector,
70: base substrate,
75: wire,
100A: high-frequency antenna module (second embodiment),
1A: substrate,
3A: amplification unit,
8A: distribution circuit,
21A: wire,
22A: wire,
23A: wire,
24A: wire,
25A: wire,
26A: wire,
200A: array antenna device,
50A: metal base,
55A: protruding portion (cooling portion),
70A: base substrate,
100B: high-frequency antenna module (third embodiment),
1B: substrate,
3B: amplification unit,
6B: input port,
8B: distribution circuit,
200B: array antenna device,
200BA: array antenna device,
100C: high-frequency antenna module (fourth embodiment),
1C: substrate,
3C: amplification unit,
6C: input port,
8C: first distribution circuit,
9C: second distribution circuit,
29: wire between distribution circuits,
200C: array antenna device,
100D: high-frequency antenna module (fifth embodiment),
3D: amplification unit,
6D: input port,
8D: distribution circuit,
16: PLL circuit (RF signal generation circuit),
34: reference signal line,
200D: array antenna device,
100E: high-frequency antenna module (sixth embodiment),
1E: substrate,
3E: amplification unit,
6E: input port,
8E: distribution circuit,
200E: array antenna device,
100F: high-frequency antenna module (seventh embodiment),
1F: substrate,
3F: amplification unit,
6F: input port,
8F: distribution circuit,
200F: array antenna device,
100G: high-frequency antenna module (eighth embodiment),
1G: substrate,
3G: amplification unit,
6G: input port,
8G: distribution circuit,
200G: array antenna device,
100H: high-frequency antenna module (ninth embodiment),
1H: substrate,
3H: amplification unit,
6H: input port,
8H: distribution circuit,
200H: array antenna device.

The invention claimed is:

1. A high-frequency antenna module comprising:
a substrate;
an input port to which an RF signal is inputted;
a distribution circuit configured to distribute the RF signal inputted to the input port;
a plurality of amplification units which each have a plurality of cascade-connected amplifiers configured to amplify the RF signal distributed by the distribution circuit, and which are arranged on a first side of the substrate provided with the distribution circuit to be rotationally symmetric about the distribution circuit;
a plurality of antennas provided on a second side of the substrate opposite to the first side provided with the amplification units, and each of the plurality of antennas is configured to emit the RF signal amplified by the amplification unit corresponding thereto to a space; and
a plurality of RF signal supplying portions, each of the plurality of RF signal supplying portions being configured to supply the RF signal amplified by the amplification unit to the antenna corresponding thereto.

2. The high-frequency antenna module according to claim 1, further comprising a metal casing configured to house the amplification units and the distribution circuit between the substrate and the metal casing, and dissipate heat generated by a plurality of heat generating portions of the amplification units.

3. The high-frequency antenna module according to claim 2, wherein the heat generating portions are arranged at corner portions of the substrate.

4. The high-frequency antenna module according to claim 2, wherein the heat generating portions are arranged at positions where a distance between the heat generating portions is more than or equal to a determined distance, and a distance between each heat generating portion and an end of the substrate is more than or equal to another determined distance.

5. An array antenna device comprising:

a plurality of high-frequency antenna modules according to claim 2 arranged in a two-dimensional array;

a base substrate having a plurality of connectors connected to the input port;

a module holding portion configured to hold the plurality of high-frequency antenna modules and the base substrate; and a cooling portion configured to pass through an opening provided in the base substrate, and come into contact with the metal casing to cool the metal casing.

6. The array antenna device according to claim 5, wherein the cooling portion is brought into contact with at least one of the metal casings at a position corresponding to at least one of the plurality of heat generating portions of the array antenna device.

7. The array antenna device according to claim 5, wherein the cooling portion is brought into contact with the metal casings at positions corresponding to the plurality of heat generating portions of the array antenna device.

8. The high-frequency antenna module according to claim 1, wherein the high-frequency antenna module comprises four amplification units, and the substrate has a main surface having a shape of a square.

9. An array antenna device comprising:

a plurality of high-frequency antenna modules according to claim 1 arranged in a two-dimensional array;

a base substrate having a plurality of connectors connected to the input port; and a module holding portion configured to hold the plurality of high-frequency antenna modules and the base substrate.

10. A high-frequency antenna module comprising:

a substrate;

an input port to which a reference signal is inputted;

a distribution circuit configured to distribute the reference signal inputted to the input port;

a plurality of amplification units which each have an RF signal generation circuit configured to generate an RF signal based on the reference signal distributed by the distribution circuit, and a plurality of cascade-connected amplifiers configured to amplify the RF signal generated by the RF signal generation circuit, and which are arranged on a first side of the substrate provided with the distribution circuit to be rotationally symmetric about the distribution circuit;

a plurality of antennas provided on a second side of the substrate opposite to the first side provided with the amplification units, and each of the plurality of antennas is configured to emit the RF signal amplified by the amplification unit corresponding thereto to a space; and a plurality of RF signal supplying portions, each of the plurality of RF signal supplying portions being configured to supply the RF signal amplified by the amplification unit to the antenna corresponding thereto.

11. The high-frequency antenna module according to claim 10, further comprising a metal casing configured to house the amplification units and the distribution circuit between the substrate and the metal casing, and dissipate heat generated by heat generating portions of the amplification units.

12. The high-frequency antenna module according to claim 11, wherein the heat generating portions are arranged at corner portions of the substrate.

13. The high-frequency antenna module according to claim 11, wherein the heat generating portions are arranged at positions where a distance between the heat generating portions is more than or equal to a determined distance, and a distance between each heat generating portion and an end of the substrate is more than or equal to another determined distance.

14. An array antenna device comprising:

a plurality of high-frequency antenna modules according to claim 11 arranged in a two-dimensional array;

a base substrate having a plurality of connectors connected to the input port;

a module holding portion configured to hold the plurality of high-frequency antenna modules and the base substrate; and a cooling portion configured to pass through an opening provided in the base substrate, and come into contact with the metal casing to cool the metal casing.

15. The array antenna device according to claim 14, wherein the cooling portion is brought into contact with at least one of the metal casings at a position corresponding to at least one of the plurality of heat generating portions of the array antenna device.

16. The array antenna device according to claim 14, wherein the cooling portion is brought into contact with the metal casings at positions corresponding to the plurality of heat generating portions of the array antenna device.

17. The high-frequency antenna module according to claim 10, wherein the high-frequency antenna module comprises four amplification units, and the substrate has a main surface having a shape of a square.

18. An array antenna device comprising:

a plurality of high-frequency antenna modules according to claim 10 arranged in a two-dimensional array;

a base substrate having a plurality of connectors connected to the input port; and a module holding portion configured to hold the plurality of high-frequency antenna modules and the base substrate.

* * * * *